US008036573B2

(12) United States Patent
Shono et al.

(10) Patent No.: US 8,036,573 B2
(45) Date of Patent: Oct. 11, 2011

(54) PROCESS CARTRIDGE AND IMAGE FORMING APPARATUS INCLUDING A TONER CHARGE CONTROL DEVICE WITH AN ENDLESS BELT

(75) Inventors: Hidekazu Shono, Takarazuka (JP); Naoki Nakatake, Nishinomiya (JP); Tetsumaru Fujita, Nishinomiya (JP)

(73) Assignee: Ricoh Company, Ltd., Tokyo (JP)

( * ) Notice: Subject to any disclaimer, the term of this patent is extended or adjusted under 35 U.S.C. 154(b) by 438 days.

(21) Appl. No.: 12/187,021

(22) Filed: Aug. 6, 2008

(65) Prior Publication Data

US 2009/0041491 A1 Feb. 12, 2009

(30) Foreign Application Priority Data

Aug. 8, 2007 (JP) ..... 2007-206497

(51) Int. Cl.
*G03G 21/00* (2006.01)

(52) U.S. Cl. ..... 399/129; 399/343; 399/345

(58) Field of Classification Search ..... 399/129, 399/343, 345

See application file for complete search history.

(56) References Cited

U.S. PATENT DOCUMENTS

| | | | | |
|---|---|---|---|---|
| 3,656,948 | A * | 4/1972 | Mammino | 430/117.3 |
| 4,650,311 | A * | 3/1987 | Mayer | 399/129 |
| 6,009,297 | A * | 12/1999 | Maeda et al. | 399/302 |
| 2006/0120767 | A1 * | 6/2006 | Miyamoto et al. | 399/267 |
| 2007/0059034 | A1 | 3/2007 | Fujita | |
| 2007/0065179 | A1 | 3/2007 | Fujita | |
| 2007/0147893 | A1 | 6/2007 | Nakatake et al. | |
| 2007/0172259 | A1 | 7/2007 | Fujita | |
| 2007/0280735 | A1 | 12/2007 | Nagatomo et al. | |
| 2008/0038017 | A1 | 2/2008 | Fujita et al. | |
| 2008/0056745 | A1 | 3/2008 | Fujita et al. | |
| 2008/0069592 | A1 | 3/2008 | Fujita et al. | |
| 2008/0131162 | A1 | 6/2008 | Nakatake et al. | |
| 2008/0145100 | A1 | 6/2008 | Sakagawa et al. | |
| 2008/0152384 | A1 | 6/2008 | Fujita et al. | |
| 2008/0152385 | A1 | 6/2008 | Fujita et al. | |
| 2008/0181654 | A1 | 7/2008 | Sakagawa et al. | |
| 2008/0181655 | A1 | 7/2008 | Sakagawa et al. | |

FOREIGN PATENT DOCUMENTS

JP 2008-046172 2/2008

OTHER PUBLICATIONS

U.S. Appl. No. 11/954,342, filed Dec. 12, 2007, Sakagawa et al.
U.S. Appl. No. 12/023,544, filed Jan. 31, 2008, Sakagawa et al.
U.S. Appl. No. 12/021,630, filed Jan. 29, 2008, Fujita et al.

* cited by examiner

*Primary Examiner* — David Gray
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes an image carrying member, an image writing unit, a development unit, a transfer device, a charging device, and a toner charge control device. The image writing unit forms a latent image on the image carrying member, which is developed as a toner image by the development unit, and the toner image is transferred to a transfer member by the transfer device. The charging device charges the image carrying member and toner on the image carrying member. The toner charge control device, controls a polarity of charge and charging voltage level of toner remaining on the image carrying member. The toner charge control device includes an endless belt having a surface made of a conductive material, a support member extending the endless belt pressed against the image carrying member, and a bias voltage applicator for supplying a voltage to the surface of the endless belt.

18 Claims, 3 Drawing Sheets

PROCESS CARTRIDGE AND IMAGE FORMING APPARATUS INCLUDING A TONER CHARGE CONTROL DEVICE WITH AN ENDLESS BELT

CROSS-REFERENCE TO RELATED APPLICATIONS

This application claims priority 35 U.S.C. §119(a) to Japanese Patent Application No. 2007-206497, filed on Aug. 8, 2007 in the Japan Patent Office, the entire contents of which are hereby incorporated by reference herein.

BACKGROUND OF THE INVENTION

1. Field of the Invention

The present disclosure generally relates to an image forming apparatus, such as a copier, a facsimile, or a printer, and a process cartridge used for an image forming apparatus.

2. Description of the Background Art

Typically, an image forming apparatus using electrophotography produces an image by sequentially conducting a series of processes such as a charging process, an exposure process, a development process, a transfer process, a fixing process, and a cleaning process, for example. In the charging process, an image carrying member, such as a photoconductor, is uniformly charged. In the exposure process, an electrostatic latent image is formed on the image carrying member by scanning a light beam on the charged image carrying member. In the development process, the electrostatic latent image is developed as a toner image. In the transfer process, the toner image is transferred directly to a recording medium or indirectly transferred to a recording medium using an intermediate transfer device. In the fixing process, the toner image is fixed on the recording medium. In the cleaning process, the image carrying member is cleaned to remove residual materials, such as toner particles, remaining on the image carrying member after the transfer process. In general, such a cleaning process is conducted by using a cleaning blade, such as a rubber blade made of elastic material, in which the cleaning blade is pressed against the image carrying member to remove or scrape toner particles remaining on the image carrying member after the transfer process.

In addition to such a cleaning process using a cleaning blade, another configuration that does not use such cleaning blade has been developed as a "cleanerless system," in which toner remaining on an image carrying member is removed and recovered after a transfer process without using a cleaning blade and a recovery system specifically used for collecting toner.

FIG. 1 illustrates an example schematic configuration of an image forming apparatus employing such a cleanerless system. As illustrated in FIG. 1, such an image forming apparatus includes a toner charge control device 105 to realize the cleanerless system, for example. The image forming apparatus further includes an image carrying member 101, a charging device 102 for charging the image carrying member 101, a development unit 106, and a transfer roller 104 for transferring a toner image from the image carrying member 101 to a transfer member 103. The toner charge control device 105 is disposed at a space between the transfer roller 104 and the charging device 102 with respect to a direction of rotation of the image carrying member 101. Specifically, the toner charge control device 105 is disposed at a downstream of the transfer roller 104 and at an upstream of the charging device 102 with respect to a direction of rotation of the image carrying member 101 as shown in FIG. 1. The toner charge control device 105 controls the polarity of charge and the charging voltage level of toner remaining on the image carrying member 101 after a transfer process. Hereinafter, the toner remaining on the image carrying member 101 after the transfer process may be referred to as "remaining toner" for the simplicity of expression.

The remaining toner is supplied with a given voltage having one polarity from the toner charge control device 105, in which the toner charge control device 105 supplies a given voltage having the same polarity as the toner. With such configuration, the polarity of charge and the charging voltage level of the remaining toner can be adjusted to a given level.

The remaining toner having the adjusted polarity and charging voltage level is then transported to a portion facing the charging device 102 by rotation of the image carrying member 101. The charging device 102, such as a fur brush roller, supplies a given bias voltage, composed of direct current having a same polarity as the toner and an alternating current superimposed to the direct current, to the remaining toner. When such bias voltage is supplied to the remaining toner, the remaining toner is separated from a surface of the image carrying member 101, and then recovered to the charging device 102.

After a given time later, the charging device 102 is set to a toner ejection mode, in which the charging device 102 is supplied with a given voltage having only direct current, so as to transfer the remaining toner, recovered in the charging device 102 as above described, to the surface of the image carrying member 101. Such transferred remaining toner is transported to a portion facing the development unit 106 with a rotation of the image carrying member 101, and is recovered into the development unit 106.

As such, a cleanerless system can reduce an amount of waste toner and can omit devices specifically used for transporting and colleting waste toner, by which an image forming apparatus can be configured with a smaller size. In such a cleanerless system, the toner charge control device 105 is used to enhance a recovery performance of remaining toner.

For example, the toner charge control device 105 may employ a conductive sheet as shown in FIG. 1, which has a relatively small and inexpensive structure. FIG. 2 illustrates an expanded view of the toner charge control device 105 employing a conductive sheet. As illustrated in FIG. 2, the toner charge control device 105 includes a conductive sheet 105*a*, an elastic member 105*b*, and a casing 110, for example. As shown in FIG. 2, one end of the conductive sheet 105*a* is fixed to the casing 110, and a free end portion of the conductive sheet 105*a* is pressed against a surface of the image carrying member 101 using the elastic member 105*b* that biases the conductive sheet 105*a* to the image carrying member 101. However, such configuration may have some drawbacks as described below.

In the configuration shown in FIG. 1, a same portion of the conductive sheet 105*a* may be consistently pressed to the image carrying member 101, by which the remaining toner may stick to such portion of the conductive sheet 105*a*. If toner sticks on the conductive sheet 105*a*, a charge control of remaining toner may not be conducted effectively, and resultantly, abnormal or defective image may be produced.

Further, the conductive sheet 105*a* may not be pressed to the image carrying member 101 with a sufficient contact area, which is needed for sufficiently controlling a polarity of charged toner and charging voltage level of charged toner. Although such charge control can be conducted by increasing a voltage supplied to the conductive sheet 105*a* even if the conductive sheet 105*a* is pressed to the image carrying member 101 with a smaller contact area, such increased voltage may cause a greater electrical stress to a photosensitive layer of the image carrying member 101, and resultantly, an abnormal or defective image may be produced.

Although such contact area of the conductive sheet 105*a* can be increased by some amount by increasing a size of the elastic member 105*b*, which presses the conductive sheet 105*a*, such increased contact area may cause uneven charge distribution between the conductive sheet 105*a* and the image carrying member 101. Further, because the free end portion of the conductive sheet 105*a* may not be pressed to the image carrying member 101 at a desired position easily, the image carrying member 101 and the conductive sheet 105*a* may not contact each other with a desired contact area.

Further, the conductive sheet 105*a* may be deformed when an image forming apparatus is not used for a long period of time. If such deformation occurs to the conductive sheet 105*a*, a contact condition of the conductive sheet 105*a* and the image carrying member 101 changes over time, and a charge control condition for the remaining toner may undesirably fluctuate or vary, and resultantly a lifetime of the conductive sheet 105*a* may be reduced. Although such deformation can be prevented by providing a deformation preventor for the conductive sheet 105*a*, such configuration may increase a cost and a size of an image forming apparatus.

In light of such background, a cleanerless system that effectively conducts charge control of toner remaining after a transfer process is desired. Such a cleanerless system may reduce occurrence of abnormal or defective images, and enhance a lifetime of an image forming apparatus or a process cartridge.

SUMMARY

In an aspect of the present disclosure, an image forming apparatus includes an image carrying member, an image writing unit, a development unit, a transfer device, a charging device, and a toner charge control device. The image writing unit forms an electrostatic latent image on the image carrying member. The development unit develops the electrostatic latent image on the image carrying member as a toner image. The transfer device transfers the toner image from the image carrying member to a transfer member. The charging device selectively charges the image carrying member and toner adhered on the image carrying member at a given timing. The toner charge control device, disposed between the transfer device and the charging device along a surface moving direction of the image carrying member, controls a polarity of charge and charging voltage level of toner remaining on the image carrying member after the toner image is transferred to the transfer member. The toner charge control device includes an endless belt, a tension roller, and a bias voltage applicator. The endless belt has a surface made of a conductive material. The tension roller extends the endless belt to press the endless belt against the image carrying member. The bias voltage applicator supplies a bias voltage to the surface of the endless belt.

In another aspect of the present disclosure, a process cartridge detachably mountable to an image forming apparatus includes an image carrying member, and a toner charge control device. The image carrying member forms an image thereon. The toner charge control device, disposed along a surface moving direction of the image carrying member used for forming an electrostatic latent image and a toner image thereon, controls polarity of charge and charging voltage level of toner remaining on the image carrying member after the toner image is transferred to a transfer member. The toner charge control device includes an endless belt, a tension roller, and a bias voltage applicator. The endless belt has a surface made of a conductive material. The tension roller extends the endless belt to press the endless belt against the image carrying member. The bias voltage applicator supplies a bias voltage to the surface of the endless belt.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
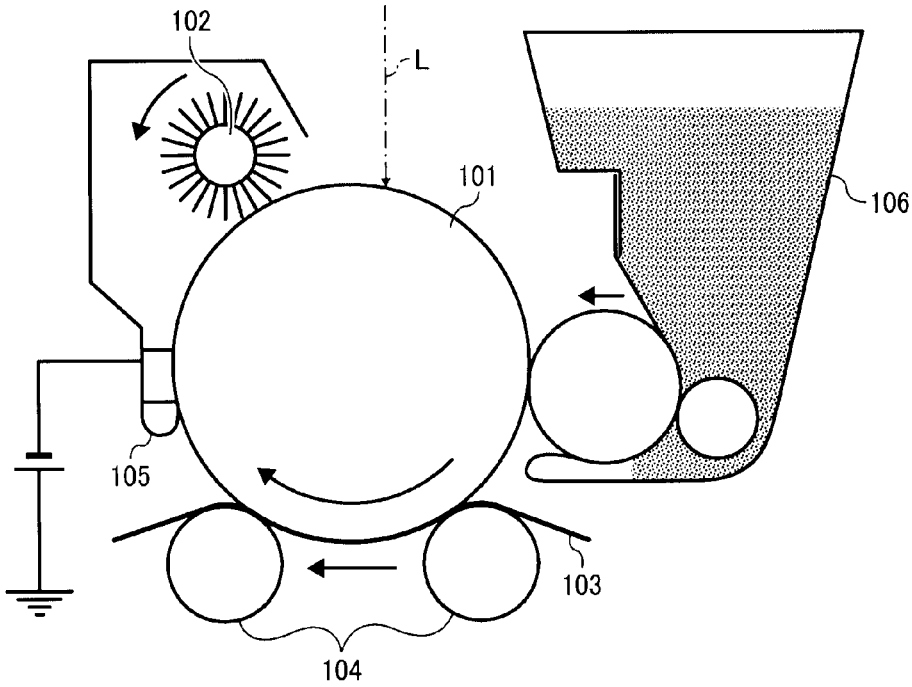
FIG. 1 CONVENTIONAL ART
FIG. 1 illustrates a schematic configuration of an image forming apparatus employing a conventional cleanerless system.
Figure 2:
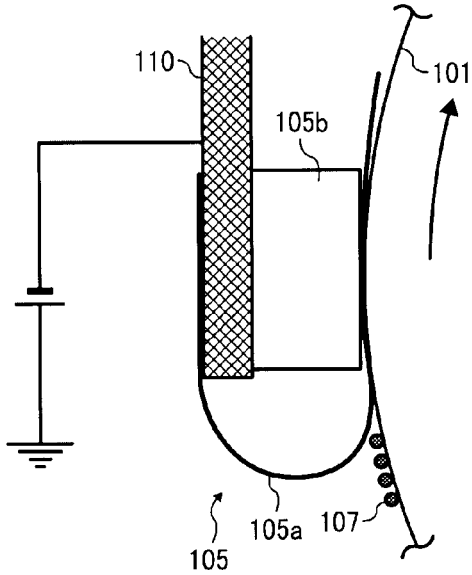
FIG. 2 CONVENTIONAL ART
FIG. 2 illustrates an expanded view of a conventional toner charge control device used in an image forming apparatus of FIG. 1.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner. Referring now to the drawings, an image forming apparatus according to an exemplary embodiment is described with reference to FIGS. 3 to 6. Such image forming apparatus may be a color printer employing electrophotography, for example, but not limited thereto.

Figure 3:
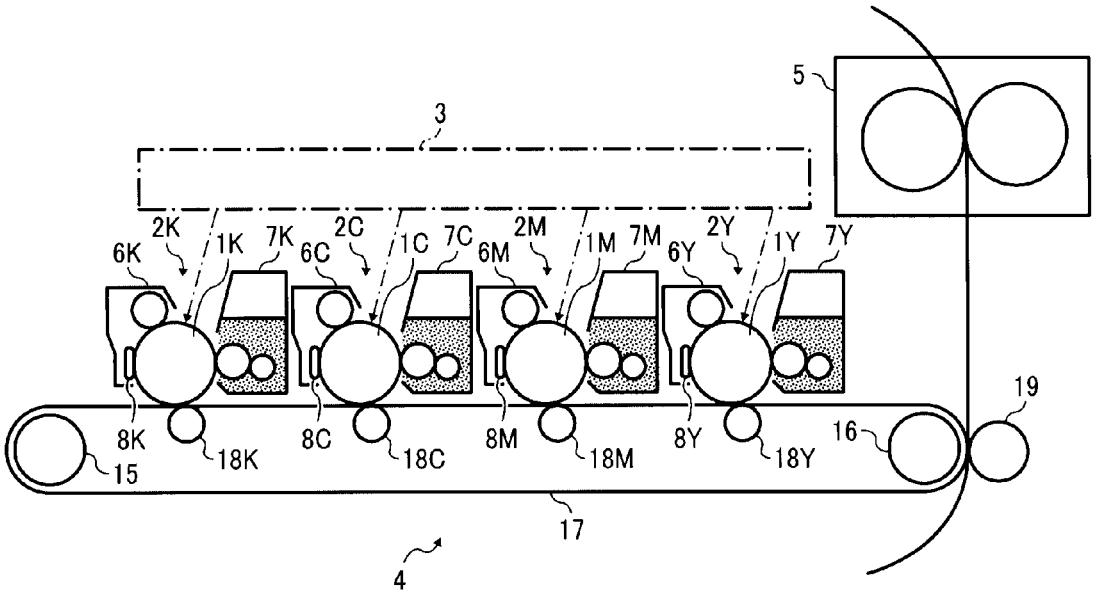
FIG. 3 illustrates a schematic configuration of an image forming apparatus according to an exemplary embodiment.

FIG. 3 illustrates a schematic configuration of an image forming apparatus according to an exemplary embodiment. As illustrated in FIG. 3, the image forming apparatus includes image forming engines 2Y, 2M, 2C, and 2K, an optical writing unit 3, an intermediate transfer unit 4, and a fixing unit 5, for example. The image forming engines 2Y, 2M, 2C, and 2K respectively include photoconductors 1Y, 1M, 1C, and 1K as image carrying members to form toner images of yellow, magenta, cyan, and black. The optical writing unit 3 writes an electrostatic latent image on each of the photoconductors 1Y, 1M, 1C, and 1K by scanning a laser beam L to each of the photoconductors 1Y, 1M, 1C, and 1K based on image information prepared from an original image, such as a document image. The intermediate transfer unit 4 includes an intermediate transfer belt 17, to which toner images formed on the photoconductors 1Y, 1M, 1C, and 1K are transferred at first. Then the toner images are transferred from the intermediate transfer belt 17 to a recording medium, such as a transfer sheet. The fixing unit 5 fixes the toner image on the transfer sheet. In this disclosure, the suffix letters of Y, M, C, and K attached to devices or the like respectively indicate yellow (Y), magenta (M), cyan (C), and black (K).

Figure 4:
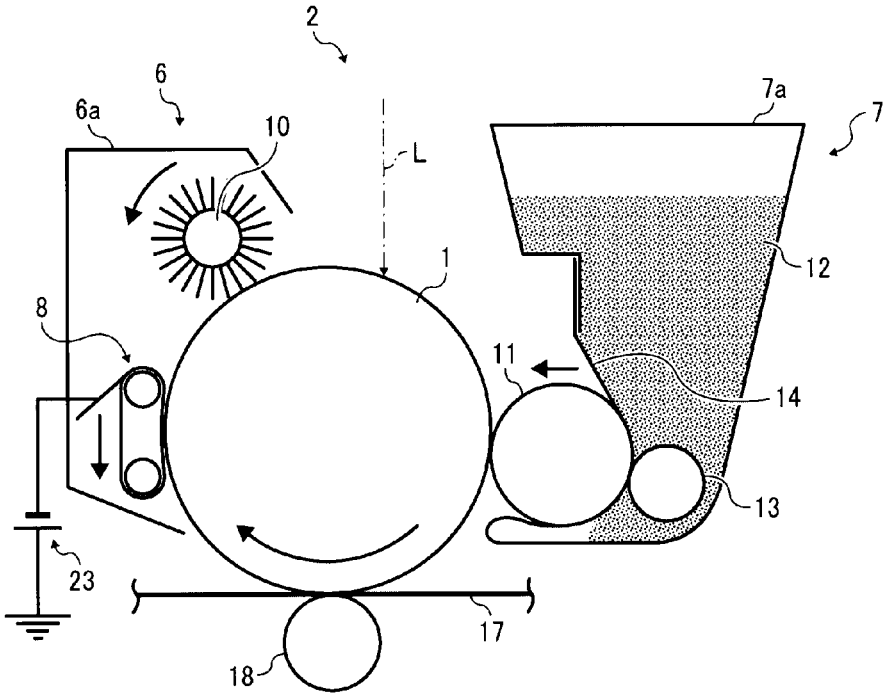
FIG. 4 illustrates a schematic configuration of an image forming engine used in the image forming apparatus of FIG. 3.

FIG. 4 illustrates a schematic configuration of the image forming engine 2. Because the image forming engines 2Y, 2M, 2C, and 2K have a similar configuration one another except for the toner color used for forming Y, M, C, and K toner images, the image forming engine 2 is used as a representative of image forming engines 2Y, 2M, 2C, and 2K. Similarly, other units or devices having similar configuration one another, such as photoconductors 1Y, 1M, 1C, and 1K, may also be referred without adding suffix letters of Y, M, C, and K, hereinafter.

As illustrated in FIG. 4, the image forming engine 2 includes the photoconductor 1, a charge unit 6, a development unit 7, and a toner charge control device 8, for example, in which the photoconductor 1 is surrounded by the charge unit 6, the development unit 7, and the toner charge control device 8, for example. The charge unit 6 uniformly charges the photoconductor 1 to a given potential. The development unit 7 develops an electrostatic latent image formed on the photoconductor 1 as a toner image. The toner charge control device 8 controls the polarity of charge and charging voltage level of toner remaining on the photoconductor 1 after a transfer process.

Further, the image forming engine 2 may include a casing for integrating the photoconductor 1, the charge unit 6, the development unit 7, and the toner charge control device 8 as one unit, such as a process cartridge, so that the image forming engine 2 is detachably mountable to the image forming apparatus. Although the charge unit 6 and the toner charge control device 8 are both supported by a common casing (i.e., a casing 6*a*), the charge unit 6 and the toner charge control device 8 can be supported separately using different casings. Because the image forming engine 2 may be used as a process cartridge detachably mountable to the image forming apparatus, each of the image forming engines 2Y, 2M, 2C, and 2K may be replaced independently with new process cartridge when a lifetime of components or parts has expired, or can be removed independently when maintenance work is required. Accordingly, a replacement or maintenance work of the image forming engine 2 can be conducted efficiently.

The photoconductor 1 is mainly composed of a conductive base material, such as an aluminum tube, and a photosensitive layer formed on the conductive base. The photosensitive layer may be composed of an organic material, such as organic photoconductor (OPC), for example. Such photoconductor 1 may have a drum shape, for example, but is not limited thereto. As illustrated in FIG. 4, the photoconductor 1 can be rotated in a given direction, such as for example clockwise direction, at a given linear velocity by a drive unit when an image forming operation, such as printing, is conducted.

The charge unit 6 includes a brush roller 10, which rotates in a counter-clockwise direction in FIG. 4 while being contacted against the photoconductor 1. The brush roller 10 includes a core (e.g., core metal) and conductive fur brushes implanted on the core. The brush roller 10 is connected to a high-voltage power supply. The high-voltage power supply can supply charging bias voltage, such as a direct current voltage or a superimposed voltage composed of a direct current and an alternating current superimposed on the direct current. A surface of the photoconductor 1 can be uniformly charged by a charging process between the photoconductor 1 and the brush roller 10 to a given polarity, which is the same as a polarity of toner to be charged.

Further, as described later, the charge unit 6 temporarily recovers toner remaining on the photoconductor 1 after a transfer process and re-transfers the recovered toner to the photoconductor 1 at a given timing.

The development unit 7 includes a casing 7*a*, a developing roller 11, toner 12, a supply roller 13, and a doctor blade 14, for example. The developing roller 11 having a surface layer made of an elastic material is partially exposed to an outside of the casing 7*a* through an opening of the casing 7*a*. The supply roller 13 supplies the toner 12 stored in the casing 7*a* to the developing roller 11. The doctor blade 14 is pressed against the developing roller 11 to regulate property of toner layer on the developing roller 11, such as thickness of toner layer.

The development unit 7 may use one-component development agent for a developing process, in which the toner 12, which is one-component development agent and stored in the casing 7*a*, is carried by the supply roller 13 and then transported and supplied to the developing roller 11. The doctor blade 14 is used to set a thin layer of toner (hereinafter, "toner layer") on the developing roller 11. Then, the toner layer on the developing roller 11 contacts an electrostatic latent image formed on the photoconductor 1 at a developing area to develop the electrostatic latent image as a toner image. The developing roller 11 faces the photoconductor 1 at the developing area. Although such development method using one-component development agent is employed in an exemplary embodiment, a development method using two-component development agent, having toner and magnetic carrier, can also be employed.

As illustrated in FIG. 3, the intermediate transfer unit 4 includes the intermediate transfer belt 17 extended by a drive roller 15 and a tension roller 16, and primary transfer rollers 18Y, 18M, 18C, and 18K, for example. The primary transfer rollers 18Y, 18M, 18C, and 18K respectively form a primary transfer nip with the photoconductors 1Y, 1M, 1C, and 1K via the intermediate transfer belt 17 sandwiched therebetween. Although not shown, the intermediate transfer unit 4 may further include a decoupling/coupling unit, and a belt cleaning unit. The decoupling/coupling unit decouples the intermediate transfer belt 17 and the transfer roller 18 from the photoconductor 1, and couples the intermediate transfer belt 17 and the transfer roller 18 to the photoconductor 1 at a given timing. The belt cleaning unit may include a blade made of an elastic material to clean the intermediate transfer belt 17.

In the intermediate transfer unit 4, toner images formed on the photoconductors 1Y, 1M, 1C, and 1K are sequentially superimposed and transferred to the intermediate transfer belt 17 at the primary transfer nip by applying transfer bias voltages from the primary transfer rollers 18Y, 18M, 18C, and 18K, by which a full color toner image is formed on the intermediate transfer belt 17. Further, a secondary transfer roller 19 is opposed to the tension roller 16 in the intermediate transfer unit 4 to set a secondary transfer nip between the intermediate transfer belt 17 and the secondary transfer roller 19. The full color toner image on the intermediate transfer belt 17 is transported to the secondary transfer nip with a traveling movement of the intermediate transfer belt 17.

The image forming apparatus may have a sheet cassette that stores a given volume of recording media. A top sheet of the recording media is fed to registration roller(s) through a sheet feed path at a given timing. The registration roller sandwiches the recording medium and stops movement of the recording medium. The registration roller then feeds the recording medium to the secondary transfer nip at a given timing synchronized to a time at which the full color toner image on the intermediate transfer belt 17 is transported to the secondary transfer nip. At the secondary transfer nip, the full color toner image on the intermediate transfer belt 17 is transferred to the recording medium by applying a transfer bias voltage from the secondary transfer roller 19, by which a full color image is formed on the recording medium. The recording medium is then transported to the fixing unit 5 to fix the full color image on the recording medium, and then ejected outside the image forming apparatus.

A surface of the photoconductor 1, passed through the primary transfer nip, has toner remaining after a transfer process (hereinafter, may be referred to as remaining toner) The remaining toner comes to a position facing the toner charge control device 8 with a rotation of the photoconductor 1. Such remaining toner before coming to the toner charge control device 8 may include toner particles having various charge conditions. For example, some toner particles are charged to a normal polarity charged to a sufficient level, some toner particles are charged to a normal polarity but not charged to a sufficient level, and other toner particles are not charged to a normal polarity (i.e., the opposite polarity of normal polarity). The normal polarity of toner particles can be set to any polarity depending on a design concept.

Figure 5:
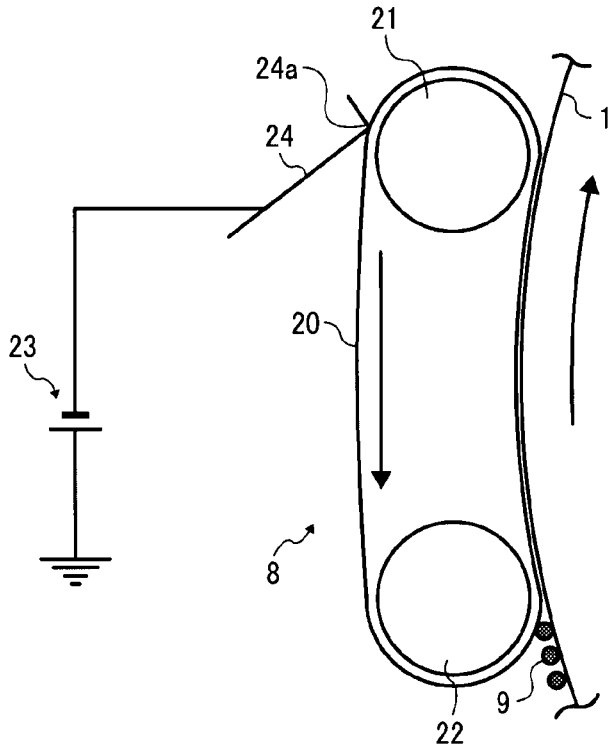
FIG. 5 illustrates an expanded view of a toner charge control device according to an exemplary embodiment used in the image forming engine of FIG. 4.

A description is now given to the toner charge control device 8 with reference to FIG. 5, which illustrates a schematic configuration of the toner charge control device 8 as one example. As illustrated in FIG. 5, the toner charge control device 8 includes a loop belt 20, a drive roller 21, and a tension roller 22, for example. The loop belt 20, made of an elastic material, includes a conductive material at least in its surface portion, and the loop belt 20 is extended by the drive roller 21 and the tension roller 22. Accordingly, the loop belt 20 can be rotated in a given direction endlessly, and the loop belt 20 can be referred as an endless belt. Further, the toner charge control device 8 includes a pressing member (e.g., spring) to press the drive roller 21 and the tension roller 22 toward the photoconductor 1. The high-voltage power supply 23 applies a biasing voltage to a surface of the loop belt 20. Such a configured toner charge control device 8 can be operated as described below.

The loop belt 20, extended by the drive roller 21 and the tension roller 22, can be rotated in a given direction. For example, the loop belt 20 can be rotated in a direction shown by an arrow in FIG. 5. An outer face of the loop belt 20, extending in an axial direction of the photoconductor 1, can be substantially evenly pressed against a surface of the photoconductor 1 with a given pressing force and with a given contact width to the photoconductor 1. Accordingly, the loop belt 20 and the photoconductor 1 create a nip therebetween. Because this nip is used to control the charge of toner, this nip may be referred to as a charge nip in this disclosure.

Thus, drive roller 21 and tension roller 22 are rotating support members that support the loop belt 20. In another embodiment, one of drive roller 21 and tension roller 22 may be replaced by a non-rotating support member. In another embodiment, the roller 22 may be used as a drive roller and the roller 21 may be used as a tension roller.

When remaining toner 9 remaining on the photoconductor 1 after a transfer process comes to the charge nip, the remaining toner 9 is supplied with a given direct current voltage having a normal polarity for toner from the loop belt 20. With such charge injection from the loop belt 20, the remaining toner 9 having toner particles of various charge conditions before coming to the toner charge control device 8 can be charged to a normal polarity having a sufficient level of charge amount. As above mentioned, the remaining toner 9 before coming to the toner charge control device 8 may include toner particles charged to a normal polarity charged to a sufficient level, toner particles charged to a normal polarity but not charged to a sufficient level, and other toner particles not charged to a normal polarity (i.e., the opposite polarity of normal polarity). Accordingly, a charge distribution profile of the remaining toner 9 after passing the toner charge control device 8 can be set to a profile having a preferable shape because the polarity of charge and charging voltage level of the remaining toner 9 can be adjusted by the toner charge control device 8.

In an exemplary embodiment, a surface moving speed S1 of the loop belt 20 may be set equal to or greater than a surface moving speed S2 of the photoconductor 1 ($S1 \geqq S2$), for example. Accordingly, the remaining toner 9 may not stick to the loop belt 20 so easily, by which a charge control of remaining toner 9 can be conducted effectively and reliably.

Because the loop belt 20 can endlessly travel in a given direction as above described with a give surface moving speed such as surface moving speed S1, an outer face of the loop belt 20 can be contacted to a surface of the photoconductor 1 in an endless manner when the loop belt 20 is activated. Accordingly, a toner sticking phenomenon to the loop belt 20 can be reduced compared to a conventional conductive sheet type that contacts a photoconductor at a same portion of the conductive sheet, and thereby the toner charge control device 8 can effectively and reliably conduct a charge control of remaining toner. The loop belt 20 can be driven by the drive roller 21, for example. Alternatively, the loop belt 20 can be driven by the photoconductor 1 by contacting the loop belt 20 to the photoconductor 1, in which the loop belt 20 is driven by rotation force of the photoconductor 1.

Further, in an exemplary embodiment, a surface potential V1 of the loop belt 20 is supplied with a voltage from the high-voltage power supply 23. Such surface potential V1 is set smaller than a charge initiation voltage Vs ($V1 < Vs$), wherein the charge initiation voltage Vs is a voltage when charging occurs to the photoconductor 1 by the loop belt 20.

Compared to a conventional conductive sheet, in an exemplary embodiment, a contact area of the loop belt 20 and the photoconductor 1 can be set greater because the loop belt 20 can be extended by the drive roller 21 and the tension roller 22, and such an extended face of the loop belt 20 can be pressed evenly to the surface of the photoconductor 1. Such contact area is referred as a charge nip area hereinafter. Because the charge nip area can be set relatively greater and evenly set on the photoconductor 1, remaining toner can be evenly charged at the charge nip area using a biasing voltage having a lower voltage. Such lower voltage may not cause a greater electrical stress to a photosensitive layer of the photoconductor 1, by which an occurrence of abnormal or defective image can be reduced. Further, because the photoconductor 1 and the loop belt 20 can contact each other at the charge nip in a relatively gentle manner, a lifetime of the photoconductor 1 and the loop belt 20 can be enhanced.

A description is given to a hardness of the loop belt 20, which may affect a contact condition of the loop belt 20 to the photoconductor 1. The loop belt 20 may be made of an elastic material having a given hardness. For example, the loop belt 20 may preferably have JIS (Japanese Industrial Standards)-A hardness of 40 or greater, or equivalent. When the loop belt 20 has a given hardness, the charge nip of the loop belt 20 and the photoconductor 1 can have a nip width, which may not change so easily, by which a charge control of remaining toner can be reliably conducted.

A description is given to a surface electric resistance of the loop belt 20, which may affect a charge control for toner and the prevention of abnormal charging of the loop belt 20 to the photoconductor 1. The loop belt 20 may be made of a material having a given surface electric resistance. For example, the loop belt 20 may be made of a material having a surface electric resistance from $10^2\Omega/\square$ to $107\Omega/\square$ (or Q/sq.), for example. When the loop belt 20 has such given surface electric resistance, a charge control of remaining toner can be conducted effectively and an abnormal charging can be prevented. In an exemplary embodiment, the loop belt 20 is made of a polytetrafluoroethylene (PTFE) layer having a thickness of 100 μm dispersed with carbon therein to set a surface electric resistance of $10^3\Omega/\square$ (or Q/sq.), for example. The loop belt 20 can be made of other conductive materials, such as nylon (registered trademark), urethane, and chloroprene rubber having met the above-described conditions for the loop belt 20.

Further, a surface layer 20*a* (see FIG. 6) of the loop belt 20 may preferably include an abrasive compound, such as for example cesium oxide, silica, or the like. If such an abrasive compound is included in the surface layer 20*a*, contamination stuck on the surface of the photoconductor 1 can be removed when the loop belt 20 slides on the photoconductor 1, by which a surface layer of the photoconductor 1 can be maintained at a clean state over time. Thereby, an occurrence of abnormal or defective image can be reduced. In general, contamination on the photoconductor 1 may be by-products caused by ozone or nitrogen oxides (NOx) during the image forming process, or additives of toner particles, for example.

Figure 6:
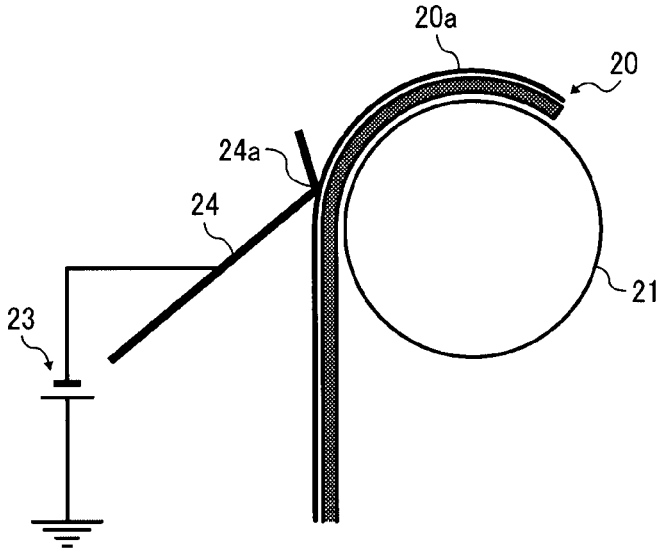
FIG. 6 illustrates an expanded view of a cleaning member disposed in the toner charge control device of FIG. 5.

Further, as shown in FIGS. 5 and 6, the loop belt 20 may be provided with a cleaning member 24, which can remove toner particles adhered on the loop belt 20. With such a configuration, the loop belt 20 can be maintained at clean state over time. FIG. 6 illustrates an expanded view of the cleaning member 24. The cleaning member 24 may have a sheet shape and be made of stainless steel, such as SUS 430, for example. The cleaning member 24 and the drive roller 21 may sandwich the loop belt 20. A free end portion of the cleaning member 24 is pressed against the loop belt 20 in a counter direction of the moving direction of the loop belt 20, for example.

Further, as illustrated in FIG. 6, the free end portion of the cleaning member 24 may have a bent portion 24*a*, which is pressed against a surface of the loop belt 20. With such configuration, the cleaning member 24 can be pressed to the loop belt 20 gently, by which the loop belt 20 may be smoothly scraped by the bent portion 24*a*, and thereby a lifetime of the loop belt 20 can be enhanced while attaining a given level of cleaning performance of the loop belt 20 over time. In other words, such bent portion 24*a* may effectively reduce or eliminate abrasion of the loop belt 20.

If such bent portion may not be provided, a leading edge of a cleaning member may contact the loop belt 20, and the loop belt 20 may be roughened or abraded by the cleaning member because the cleaning member contacts the loop belt 20 at the leading edge.

Further, the cleaning member 24 may be made of a conductive material, and connected to the high-voltage power supply 23. Under such configuration, a voltage can be supplied from the high-voltage power supply 23 to a surface layer of the loop belt 20 via the cleaning member 24. Further, such a configuration can allow variety of materials used for the loop belt 20. Specifically, because a voltage can be supplied to the surface layer of the loop belt 20 via the cleaning member 24, an inner layer of the loop belt 20 can be made of material (s) without consideration to conductivity. Accordingly, the inner layer of the loop belt 20 can be made of material having a given property, by which the loop belt 20 may have a sufficient strength for traveling the loop belt 20, and the loop belt 20 may contact the photoconductor 1 with a preferable condition.

Further, because a voltage can be supplied to the surface layer 20*a* of the loop belt 20 via the cleaning member 24, an electric potential of the loop belt 20 responds linearly to the supplied voltage, by which the potential of the loop belt 20 can be controlled and set easily. Although the cleaning member 24 is opposed to the drive roller 21 in FIG. 6, the cleaning member 24 can be opposed to the tension roller 22.

When an image forming operation is to be conducted, the brush roller 10 of the charge unit 6 applies a charging bias voltage to uniformly charge the photoconductor 1, in which the charging bias voltage may include a direct current (DC) voltage of one polarity which is the same as normal polarity of toner, and an alternating current (AC) voltage superimposed to the DC voltage. After an image transfer process at the primary transfer roller 18, the photoconductor 1 passes the primary transfer roller 18, and the remaining toner 9 remaining on the photoconductor 1 comes to the charge nip set between the photoconductor 1 and the loop belt 20 of the toner charge control device 8, at which a polarity of charge and charging voltage level of the remaining toner 9 is adjusted. Then, the remaining toner 9 comes to a position facing the charge unit 6 with a rotation of the photoconductor 1, and is recovered by the brush roller 10, such as a fur brush roller, disposed in the charge unit 6. The charge unit 6 re-transfers the recovered toner to the surface of the photoconductor 1 by switching a voltage supplied to the brush roller 10 from a superimposed voltage composed of AC and DC voltages to a direct current voltage at a given timing, such as when waiting for a sheet feed, or after a completion of one print job, for example. The toner re-transferred to the photoconductor 1 comes to a position facing the development unit 7 with a rotation of the photoconductor 1, and then is recovered into the development unit 7 by the developing roller 11, which contacts the photoconductor 1. Such recovered toner can be used again for another developing process. If the toner can be recovered as such, toner consumption can be reduced and toner can be used economically.

As above described, in an exemplary embodiment, a charge control can be effectively conducted to toner remaining after a transfer process, by which an occurrence of an abnormal or defective image can be reduced or prevented, and an image forming apparatus or a process cartridge having an extended lifetime can be devised.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An image forming apparatus, comprising:

an image carrying member;

an image writing unit configured to form an electrostatic latent image on the image carrying member;

a development unit configured to develop the electrostatic latent image on the image carrying member as a toner image;

a transfer device configured to transfer the toner image from the image carrying member to a transfer member;

a charging device configured to selectively charge the image carrying member and toner adhered on the image carrying member at a given timing;

a toner charge control device, being disposed between the transfer device and the charging device along a surface moving direction of the image carrying member, the toner charge control device configured to control a polarity of charge and charging voltage level of toner remaining on the image carrying member after the toner image is transferred to the transfer member, the toner charge control device, including:

an endless belt having an entire surface made of a conductive material;

a support member, extending the endless belt to press the endless belt against the image carrying member; and a bias voltage applicator configured to supply a same constant bias voltage to the entire surface of the endless belt.

2. The image forming apparatus according to claim 1, wherein the endless belt has a surface moving speed S1 set greater than or equal to a surface moving speed S2 of the image carrying member (S1≧S2).

3. The image forming apparatus according to claim 1, wherein a surface potential V1 of the endless belt applied by the bias voltage applicator is set smaller than a charge initiation voltage Vs at which charging occurs to the image carrying member by the endless belt (Vs>V1).

4. The image forming apparatus according to claim 1, wherein the endless belt has a JIS-A hardness of 40 or greater.

5. The image forming apparatus according to claim 1, wherein the endless belt is made of a material having a surface electric resistance from $10^2\Omega/\square$ to $10^7\Omega/\square$.

6. The image forming apparatus according to claim 1, wherein the endless belt has a surface layer including an abrasive compound.

7. The image forming apparatus according to claim 6, wherein the abrasive compound includes any one of cesium oxide and silica.

8. The image forming apparatus according to claim 1, wherein the toner charge control device further includes a cleaning device configured to clean the endless belt, and the cleaning device is opposed to the support member.

9. The image forming apparatus according to claim 8, wherein the cleaning device has a free end portion having a bent portion, and the bent portion contacts the endless belt.

10. The image forming apparatus according to claim 8, wherein the cleaning device is made of a conductive material, and the bias voltage applicator supplies a voltage to a surface of the endless belt via the cleaning device.

11. The image forming apparatus according to claim 1, wherein the support member is a rotating roller.

12. A process cartridge detachably mountable to an image forming apparatus, comprising:

an image carrying member configured to form an image thereon;

a toner charge control device being disposed along a surface moving direction of the image carrying member used for forming an electrostatic latent image and a toner image thereon, the toner charge control device configured to control a polarity of charge and charging voltage level of toner remaining on the image carrying member after the toner image is transferred to a transfer member, the toner charge control device, including:

an endless belt having an entire surface made of a conductive material;

a support member, extending the endless belt to press the endless belt against the image carrying member; and a bias voltage applicator configured to supply a same bias voltage to the entire surface of the endless belt.

13. The process cartridge according to claim 12, further comprising at least one of a development unit and a charging device.

14. The process cartridge according to claim 13, wherein the toner charge control device is disposed between a transfer device and the charging device along the surface moving direction of the image carrying member.

15. The process cartridge according to claim 12, wherein the support member is a rotating roller.

16. A process cartridge detachably mountable to an image forming apparatus, comprising:

an image carrying member configured to form an image thereon;

toner charge control means for controlling a polarity of charge and charging voltage level of toner remaining on the image carrying member after the toner image is transferred to a transfer member, said toner charge control means disposed along a surface moving direction of the image carrying member used for forming an electrostatic latent image and a toner image thereon, the toner charge control means, including:

means for receiving a voltage having an entire surface made of a conductive material;

means for extending the means for receiving to press the means for receiving against the image carrying member; and means for supplying a same bias voltage to the entire surface of the means for receiving.

17. The process cartridge according to claim 16, wherein the means for receiving is an endless belt.

18. The process cartridge according to claim 16, wherein the means for extending is a rotating roller.

* * * * *